US007156931B2

(12) United States Patent
Valentinovich et al.

(10) Patent No.: US 7,156,931 B2
(45) Date of Patent: Jan. 2, 2007

(54) MAGNESIUM-BASE ALLOY AND METHOD FOR THE PRODUCTION THEREOF

(75) Inventors: Tetyukhin Vladislav Valentinovich, Karl Libknekht (RU); Agalakov Vadim Vladimirovich, Svoboda (RU); Paderina Natalya Sergeevna, Lenina (RU)

(73) Assignee: Public Stock Company VSMPO-AVISMA Corporation (RU)

( * ) Notice: Subject to any disclaimer, the term of this patent is extended or adjusted under 35 U.S.C. 154(b) by 406 days.

(21) Appl. No.: 10/496,023

(22) PCT Filed: Apr. 22, 2002

(86) PCT No.: PCT/RU02/00188

§ 371 (c)(1),
(2), (4) Date: May 19, 2004

(87) PCT Pub. No.: WO03/056049

PCT Pub. Date: Jul. 10, 2003

(65) Prior Publication Data

US 2005/0016640 A1 Jan. 27, 2005

(30) Foreign Application Priority Data

Dec. 26, 2001 (RU) ..... 2001135898

(51) Int. Cl.
*C22C 23/02* (2006.01)
*C22C 1/03* (2006.01)

(52) U.S. Cl. ..... 148/538; 75/603; 75/604

(58) Field of Classification Search ..... 148/538; 75/603, 604

See application file for complete search history.

(56) References Cited

U.S. PATENT DOCUMENTS 5,294,267 A 3/1994 Bania et al.
5,855,697 A 1/1999 Luo et al.

FOREIGN PATENT DOCUMENTS

| | | | |
|---|---|---|---|
| DE | 1258106 | * | 1/1968 |
| DE | 2526024 | * | 7/1976 |
| RU | 1727403 | * | 11/1994 |
| SU | 393343 | * | 12/1973 |
| WO | 9949089 | * | 9/1999 |

OTHER PUBLICATIONS

Vyatkin, I.P. et al, Refining and casting of Primary Magnesium (Rafinirovanie i Lit'e Pervichnogo Magniya), (1974) Publisher: (Metallurgiya, Moscow, USSR), 191 pp. 0.52 r.*

Kurdyumov, A.V. et al., Foundry Production of Nonferrous and Rare Metals. Textbook for Students Majoring in Physical Metallurgy and Equipment and Technology for Heat Treatment of Metals. 2nd Ed (Liteinoe Proizvodstvo Tsrtnykh i Redkikh Metallov. Uchebnoe Posobie po Spetsial 'nosti Metalloredenie Oborudovanie, i Tekhnologiya Termicheskoi Obrabotki Metallov. 2-e Izd) (1982) Publisher: (Metallurgina, Moscow, USSR), 352 pp. rub 1.1.*

*References are cited and considered as in search report (PCT/RU2002/000188) submitted by applicants.*

* cited by examiner

*Primary Examiner*—Sikyin Ip
(74) *Attorney, Agent, or Firm*—Brooks Kushman P.C.

(57) ABSTRACT

The invention relates to magnesium-based alloy and, more specifically, to a magnesium alloy composition and methods of producing the same. The alloy has finer grain size, which results in improving mechanical properties of the alloy. Those mechanical properties make the alloy suitable for high-pressure casting. The alloy comprises aluminium, zinc, manganese, silicon, and calcium. A method for producing said alloy consists of loading the alloying components, pouring the molten magnesium, introducing a titanium-containing fusion cake with a flux agent and continuously agitating. The alloy is then soaked and cast.

16 Claims, No Drawings

MAGNESIUM-BASE ALLOY AND METHOD FOR THE PRODUCTION THEREOF

FIELD OF THE INVENTION

This invention relates generally to magnesium-based alloys and more specifically to magnesium alloy composition and methods of producing them that are for use in the automotive industry.

BACKGROUND OF THE INVENTION

There are various alloys developed for special applications including, for example, die casting of automotive components. Among these alloys magnesium-aluminium alloys can be designated as cost-effective and widely used for manufacture of automotive parts, e.g. AM50A alloy (where AM means aluminium and manganese are in the components of the alloy) containing approx. 5 to 6 wt. % aluminium and manganese traces, and magnesium-aluminium-zinc alloys, e.g. AZ91D (where AZ means aluminium and zinc are in the components of the alloy) containing approx. 9 wt. % aluminium and 1 wt. % zinc.

The disadvantage of these alloys is their low strength and poor creep resistance at elevated operating temperatures. As a results, the above mentioned magnesium alloys are less suitable for motor engines where some components such as transmission cases are exposed to temperatures up to 150° C. Poor creep resistance of these components can lead to a decrease in fastener clamp load in bolted joints and, hence, to oil leakage.

Known is a magnesium-based alloy (PCT/CA96/00091) comprising aluminium and calcium as alloying components in the following contents:

Aluminium—2–6 wt. %
Calcium—0.1–0.8 wt. %
Magnesium—rest being

As a drawback of the above alloy it can be noted that alloys having higher calcium content are prone to hot cracking in die casting.

Known presently is another magnesium die cast alloy (U.S. Pat. No. 5,855,697) which is taken as analogue-prototype and comprises magnesium, aluminium, zinc, and calcium as the basic alloying components in the following contents:

Aluminium—2–9 wt. %
Zinc—6–12 wt. %
Calcium—0.1–2.0 wt. %.

The alloy can also comprise other ingredients such as manganese in the amount of 0.2 to 0.5%, silicon up to 0.05% and impurities, e.g. iron in the amount of 0.01 to 0.008 wt. %.

Table 1 of the prototype patent discloses the composition of the alloys ZAC8502, ZAC8506 and ZAC8512 that comprise the components in the following contents, wt. %: 4.57–4.67 aluminium, 8.12–8.15 zinc, 0.23–1.17 calcium and 0.25–0.27 manganese. The alloy of the above composition was subjected to mechanical tests and compared to conventional alloys AZ91 and AE42 in relation to their mechanical properties. This alloy contains magnesium, aluminium, zinc and calcium as the basic alloying components whereas silicon is included in the alloy as an impurity in the amount up to 0.05% which is therefore considered to be a shortcoming of the alloy. Addition of aluminium, zinc and calcium results in the formation of intermetallic precipitates Mg—Al—Zn—Ca along grain boundaries in primary magnesium. The microstructure obtained in this alloy is characterised with a larger grain size and leads to lack of structure homogeneity which is detrimental to mechanical properties of the alloy in die-casting processes.

Presently known is the method (PCT Patent No. 94/09168) for producing a magnesium-based alloy that provides for alloying components in a molten state being introduced into molten magnesium. Primary magnesium and alloying components are therefore heated and melted in separate crucibles. Elemental manganese is alloyed here with other alloying metals before they are added in molten magnesium to increase efficiency of melt refining from iron inclusions.

What is disadvantageous of this method is the need to pre-melt manganese and other alloying elements (at the melting temperature of 1250° C.) that complicates alloy production and process instrumentation.

There are some other methods known (B. I. Bondarev "Melting and Casting of Wrought Magnesium Alloys" edited by Metallurgy Publishing House, Moscow, Russia 1973, pp 119–122) to introduce alloying elements using a master alloy, e.g. a magnesium-manganese master alloy (at the alloying temperature of 740–760° C.).

This method is disadvantageous because the alloying temperature should be kept high enough which leads to extremely high electric power consumption for metal heating and significant melting loss.

Also known is another method of producing a magnesium-aluminium-zinc-manganese alloy (I. P. Vyatkin, V. A. Kechin, S. V. Mushkov in "Primary magnesium refining and melting" edited by Metallurgy Publishing House, Moscow, Russia 1974, pp. 54–56, pp. 82–93) which is taken as an analogue-prototype. This method stipulates various ways how to feed molten magnesium, alloying components such as aluminium, zinc, manganese. One of these approaches includes simultaneous charging of solid aluminium and zinc into a crucible, then heating above 100° C., pouring in molten magnesium and again heating up to 700–710° C. and introducing titanium-containing fusion cake together and manganese metal under continuous agitation.

The main shortcoming of the method is in considerable loss of alloying components resulting in lower recovery of alloying components in magnesium and preventing from producing alloys of the specified quality. Said quantitative composition of the magnesium-based alloy is able to improve mechanical properties.

SUMMARY OF THE INVENTION

In view of the foregoing, it is an object of the present invention to prepare an alloy having a finer grain size, which results in homogeneity of the alloy structure and improves mechanical properties of the alloy. It is further an object of the invention to lower losses of the alloying components due to a specific consequence in introduction of the alloying components.

Said invention makes it possible to produce the alloy provided with mechanical properties suitable for high-pressure casting.

To accomplish objects set forth here above, there is a magnesium-based alloy proposed, which comprises aluminium, zinc, manganese, silicon, and calcium, wherein the constituents specified are in the following amounts, wt. %:

Aluminium—2.6–3.6
Zinc—0.11–0.25
Manganese—0.24–0.34
Silicon—0.8–1.1
Calcium—0.05–0.10

Magnesium—remainder.

A method for producing said alloy consists of loading of alloying components, pouring of molten magnesium, introducing a titanium-containing fusion cake together with a flux agent and continuously agitating. The alloy is soaked and cast. The alloying components of aluminium, zinc, silicon, and manganese are loaded in the form of a ready-made solid master alloy aluminium-zinc-manganese-silicon. After being poured in, the magnesium is heated, subjected to ageing and then stirred; the titanium-containing fusion cake is introduced, the magnesium is cooled and the calcium is loaded under the layer of magnesium. The proportion of calcium to magnesium is 1: (500–700). Further, magnesium is cooled to the temperature of 700–710° C.

Aluminium added into magnesium contributes to its tensile strength at ambient temperature and alloy castability. However, it is well-known that aluminium is detrimental to creep resistance and strength of magnesium alloys at elevated temperatures. This results from the case that aluminium, when in higher quantities, tends to combine with magnesium to form great amounts of intermetallic $Mg_{17}A1_{12}$ having a low melting temperature (437° C.) which impairs high-temperature properties of aluminium-based alloys. The aluminium content of 2.6–3.6 wt. % that was chosen for the proposed magnesium-based alloy provides better properties of the magnesium-based alloy, such as creep resistance. In order to enhance service performance and functionality and expand the scope of application at higher temperatures (up to 150–200° C.) silicon is present in the alloy as an alloying element, not an impurity with a specified concentration 0.8–1.1 wt %. Reacting with magnesium, silicon forms a metallurgically stable phase Of $Mg_2Si$ that is precipitated slightly at grain boundaries and, hence, improves mechanical properties of the alloy.

Calcium is the most economical element and improves high-temperature strength and creep resistance of magnesium alloys. However, when calcium is included in a magnesium-aluminum based alloy, the castability of the alloy is severely deteriorated to the extent that the alloy is no longer castable by the conventional die casting process. Larger contents of calcium result in cracking during casting. The concentration of calcium selected for the alloy in the amount of 0.05–0.10 wt. % is therefore able to prevent $Mg_2Si$ precipitates from forming large complexes which can worsen the alloy ductility and affect adversely the required mechanical properties of the alloy so that they can not be obtained.

The properties of the alloy are further influenced by zinc content and the property of alloy fluidity of the magnesium-aluminium-calcium alloy can appear with a high zinc concentration. Therefore, the proposed zinc content is within 0.11–0.25 wt % to be optimum for the magnesium-based alloy.

The alloy is loaded with manganese in the content of 0.24–0.34 wt. % in order to ensure corrosion resistance.

Alloying components are introduced in the form of the ready-make solid master alloy of aluminium-zinc-manganese-silicon, which is added in the certain proportion to magnesium, i.e. 1:(18–20), and, therfore, enhances significantly recovery of the additives in magnesium, thus lowering losses of expensive chemicals.

With process temperature maintained at 720–740° C. the level of recovery of alloying components in magnesium can be 98.8–100% in case of aluminium, 68.2–71.1% in case of manganese, 89.3–97.4 in case of silicium, 85.9–94.4% in case of zinc.

When cooling magnesium up to 700–710° C. calcium is fed at the bottom of the crucible under the layer of magnesium and this enables recovery of calcium in magnesium at the level of 70%.

The group of invention claimed meets the requirement of unity of invention and the application relates to the subject-matters of invention of the same category, of the same use of invention, aimed at the same technical effect using the same processes.

The inventions are thus based upon a novel quantitative content of constituents and a practice of introducing them into the alloy. A quantitative content of the constituents of the magnesium-based alloy enables a reduction of granules in the alloy microstructure that leads to improving of die casting mechanical properties.

A specified practice to introduce alloying components helps reduce losses of the alloying components and, as a result, the cost of the alloy.

DETAILED DESCRIPTION OF PREFERRED EMBODIMENTS

Preparation of Al—Mn—Si—Zn Master Alloy

Composition: aluminium—matrix, manganese—6.0–9.0 wt. % silicon—24.0–28.0 wt %, zinc (GOST 3640)—2.5–3.5 wt. %, inclusions, in wt. %: iron—0.4, nickel—0.005, copper—0.1, titanium—0.1. The master alloy is produced in ingots.

The master alloy is manufactured in an 'AIAX'-type induction furnace. A97 grade aluminium (acc. to GOST 11069) is charged in the furnace, heated up to 910–950° C.; the master alloy is melted under cryolite flux in the amount of 1–1.5% of the pre-weighted quantity required for the process. Kp1 (Kr1) grade crystalline silicon is fed in portions in the form of crushed pieces, or wrapped in aluminium foil or wetted with zinc chloride solution to prevent them from oxidation. Silicon is dissolved in small portions and thoroughly stirred. The composition obtained is thereafter added with manganese metal of MH95 grade (Mn95 acc. to GOST 6008) in the form of 100 mm pieces, stirred again and heated up to the temperature within 800–850° C.; finally added with II-grade zinc (Z1 acc. to GOST 3640). 16 kg ingots are cast in molds.

EXAMPLE 1

The solid master alloy of Al-Mn-Si-Zn in the form of ingots in the proportion of master alloy to magnesium 1: (18–20) are charged into a preheated crucible of furnace SMT-2. In the same crucible raw magnesium M⌈90 (MG90 acc. to GOST 804-93) is poured in the amount of 1.8 tons from a vacuum ladle and is afterwards heated. On reaching 730–740° C. of the metal temperature a heated agitator is placed in the crucible. The alloy is left undisturbed in the crucible for 1–1.5 hrs prior to mixing and then mixed for max. 40–50 min; a titanium-containing fusion cake (TU 39-008) being in the compound with barium flux in the proportion 1:1 is added, and mixed again; the temperature of the alloy is then reduced to 700–710° C. Thereafter calcium is charged in the form of crushed pieces in proportion to molten magnesium in the ratio of 1:(500–700). Calcium pieces are placed in an alloying basket and lowered to the bottom of the crucible at the temperature of molten magnesium of 700° C. The alloy produced was left in the crucible for 60 min and thereafter the alloy was sampled for chemical analysis to define Al, Mn, Zn, Si content and impurities. The alloy composition was in wt. %: Al—3.07, Mn—0.22, Si—1.03, Ca—0.05, Be—0.0008–0.0012, Zn—min 0.18, Fe—min 0.003.

INDUSTRIAL APPLICABILITY

TABLE 1

Level of recovery of alloying components in magnesium

| Constituents | Recovery level, % |
|---|---|
| Aluminium | 100 |
| Manganese | 73.5–96.3; at 720–740° C. and time of agitation 40–50 min recovery level of manganese is 80–96% |
| Silicon | 80.8–92.5 |
| Zinc | 84.8 |
| Calcium | 70.0 |

TABLE 2

Mechanical properties of the magnesium-based alloy at 150° C.

| | Tensile test | | |
|---|---|---|---|
| Type of alloy | $\sigma_B$, MPa | $\sigma_{0.2}$, % | Elongation δ, % |
| AZ91 - standard alloy | 159 | 150 | 6.7 |
| ZAC8512 - prior art | 149 | 151 | 5.1 |
| The alloy claimed | 131 | 80 | 9.4 |

As it can be seen in the table above, the tensile properties of the alloy claimed are generally identical at 150° C. However, the alloy according to the present invention shows better elongation than the prior art alloy and the standard alloy.

The invention claimed is:

1. A method for producing a magnesium-based alloy comprising the steps of:

a. loading alloying components into a crucible in the form of a master alloy including
   i. Al—remainder
   ii. Zn—2.5–3.5 wt. %
   iii. Si—24.0–28.0 wt. %
   iv. Mn—6.0–9.0 wt. %
b. pouring molten Mg into the crucible to form an alloy
   i. heating
   ii. aging; and
   iii. stirring said alloy
c. introducing a Ti-containing fusion cake with a fluxing agent to said alloy
   i. continuously agitating the cake in said alloy to form a magnesium based alloy
d. cooling the magnesium-based alloy
e. loading Ca under the Mg
f. soaking; and
g. casting said magnesium-based alloy.

2. The method of claim 1 wherein the master alloy is a solid master alloy.

3. The method of claim 1, wherein the proportion of Ca to Mg is 1:(500–700).

4. The method of claim 1, wherein Mg is cooled to 700–710° C.

5. The method of claim 1 wherein the loading step comprises loading components in the form of a ready-made solid master alloy.

6. The method of claim 1 wherein the step of loading Ca under the cooled composition is performed such that the proportion of Ca to Mg is 1:(500–700).

7. The method of claim 1 wherein the step of cooling the intermediate composition comprises cooling the intermediate composition to a temperature of about 700–710° C.

8. The method of claim 1 wherein the step of loading alloying components further comprises providing Al in the amount of 2.6–3.6 wt. % in cast magnesiun alloy.

9. The method of claim 1 wherein the step of loading alloying components comprises providing Si in the amount of 0.8–1.1 wt. % in cast magnesium alloy, the Si forming a metallurgically stable phase of $Mg_2Si$ that is precipitated at grain boundaries, thereby improving the mechanical properties of the alloy.

10. The method of claim 1 wherein the step of loading Ca comprises providing Ca in the amount of 0.05–0.10 wt. % in cast magnesium alloy for preventing the formation of large complexes of $Mg_2Si$ precipitate, thereby avoiding impairing alloy ductility.

11. The method of claim 1 wherein the step of loading alloying components further comprises providing Zn in the amount of 0.11–0.25 wt. % in cast magnesium alloy for fluidity.

12. The method of claim 1 wherein the step of loading alloying components further comprises the step of providing Mn in the amount of 0.24–0.34 wt. % in cast magnesium alloy for corrosion resistance.

13. The method of claim 1 wherein the step of loading alloying components in the form of a master alloy comprises adding a ready-made solid master alloy in a proportion to Mg of 1:(18–20) for the recovery of additives and reducing the loss of chemicals.

14. The method of claim 1 wherein steps (a–c) are conducted at 720–740° C., thereby enabling a level of alloy recovery of Al (98.8–100%); Mn (68.2–71.1%); Si 89.3–97.4%); and Zn (85.9–94.4%).

15. The method of claim 1 wherein step (d) produces a cooled composition at 700–710% C., thereby enabling a recovery of Ca at the level of 70%.

16. The method of claim 1 wherein the master alloy comprises the following components, wt. %:

Mn—6.0–9.0
Si—24.0–28.0
Zn—2.5–3.5
an inclusion selected from the group consisting of Fe 0.4; Ni 0.005; Cu 0.1; Ti 0.1 and combinations thereof; and
Al—remainder.

* * * * *